United States Patent [19]

Hattori

[11] Patent Number: 4,534,592

[45] Date of Patent: Aug. 13, 1985

[54] LUMBAR SUPPORT ADJUSTING APPARATUS

[75] Inventor: Takemi Hattori, Kariya, Japan

[73] Assignee: Aisin Seiki Kabushiki Kaisha, Kariya, Japan

[21] Appl. No.: 480,574

[22] Filed: Mar. 30, 1983

[30] Foreign Application Priority Data

Apr. 6, 1982 [JP] Japan ..... 57-57050

[51] Int. Cl.[3] ..... A47C 3/00

[52] U.S. Cl. ..... 297/284

[58] Field of Search ..... 297/284; 267/89

[56] References Cited

U.S. PATENT DOCUMENTS

| | | | |
|---|---|---|---|
| 3,973,797 | 8/1976 | Obermeier et al. | 297/284 |
| 4,019,777 | 4/1977 | Hayashi | 297/284 |
| 4,162,807 | 7/1979 | Yoshimura | 297/284 |

FOREIGN PATENT DOCUMENTS

| | | | |
|---|---|---|---|
| 2856784 | 7/1979 | Fed. Rep. of Germany | 297/284 |

*Primary Examiner*—Kenneth Downey

*Attorney, Agent, or Firm*—Finnegan, Henderson, Farabow, Garrett and Dunner

[57] ABSTRACT

A lumbar support adjusting apparatus has a release plate pressed against a ratchet by a compression spring for urging the release plate under uniform resilient forces, and biased to return in its direction of rotation by a torsion spring, preferably a spiral spring, having one end secured to a shaft and the other end to a support plate. The compression force of the compression spring, and the torsional force of the spiral spring can be set independently of each other. The release plate can turn the ratchet and can be angularly returned to its original position smoothly and reliably without fail.

6 Claims, 8 Drawing Figures

LUMBAR SUPPORT ADJUSTING APPARATUS

BACKGROUND OF THE INVENTION

The present invention relates to a lumbar support adjusting apparatus for use in a seat back, and more particularly to an apparatus for adjusting the pressing force of a lumbar support mounted in the back of a seat.

Prior lumbar support adjusting apparatus include a torsion bar supporting a lumbar plate, a cam engaging the torsion bar, a ratchet nonrotatably mounted on a shank of the cam and having radial engagement members, and a handle-operated release plate having pawls engageable with the engagement members and normally biased against the ratchet by a conical spring. The conventional lumbar support adjusting apparatus have proven unsatisfactory in that the pawls of the release plate are liable to disengage from the engagement members, failing to rotate the cam. As a result, the pressing force by the lumbar plate cannot be adjusted properly.

SUMMARY OF THE INVENTION

It is an object of the present invention to provide a lumbar support adjusting apparatus which eliminates the prior drawbacks.

Another object of the present invention is to provide a lumbar support adjusting apparatus having a release plate capable of smoothly and reliably feeding a ratchet and returning itself.

According to the present invention, a release plate is pressed against a ratchet by a compression spring for urging the release plate under uniform resilient forces, and is biased to return in its direction of rotation by a torsion spring, preferably a spiral spring, having one end secured to a shaft and the other end to a support plate. These springs are assembled in given spaces in a lumbar support adjusting apparatus. The compression force of the compression spring, and the torsional force of the spiral spring can be set independently of each other. The release plate can turn the ratchet and can be angularly returned to its original position smoothly and reliably without fail.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
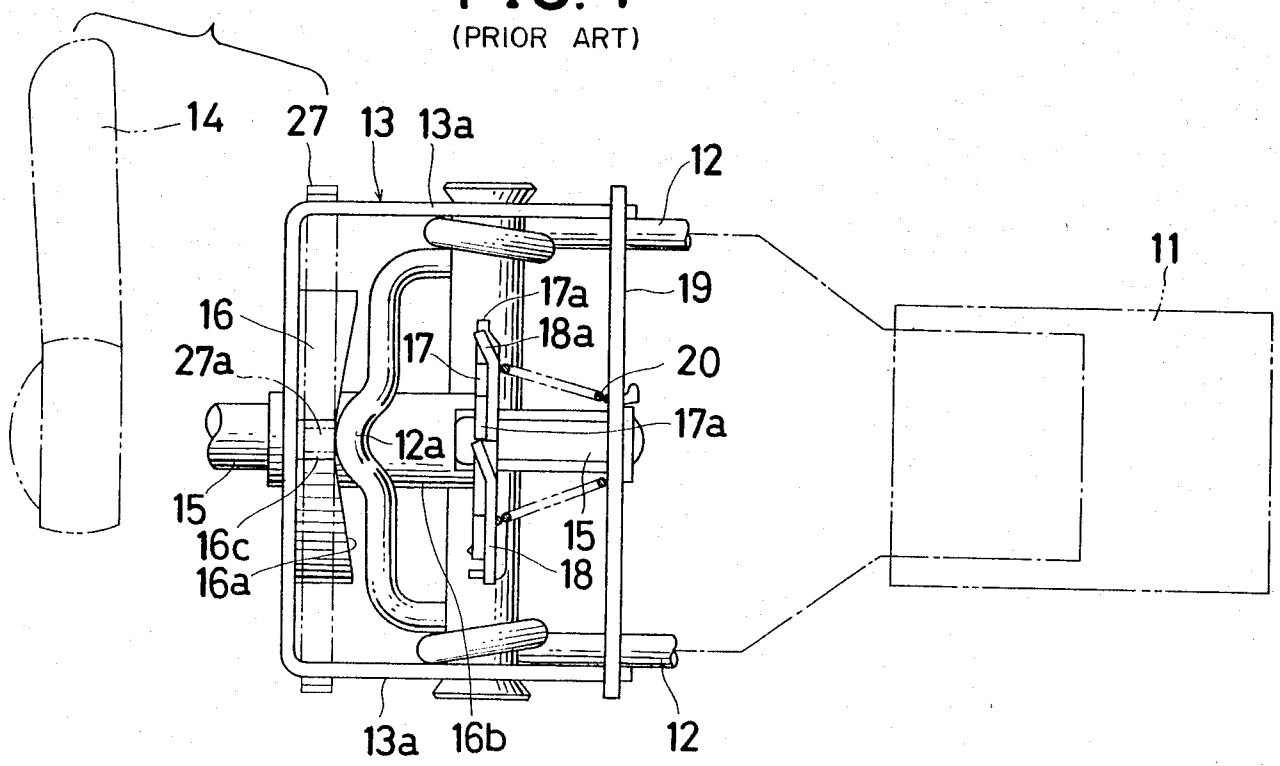
FIG. 1 (PRIOR ART)
FIG. 1 is a front elevational view of a conventional lumbar support adjusting apparatus.
Figure 2:
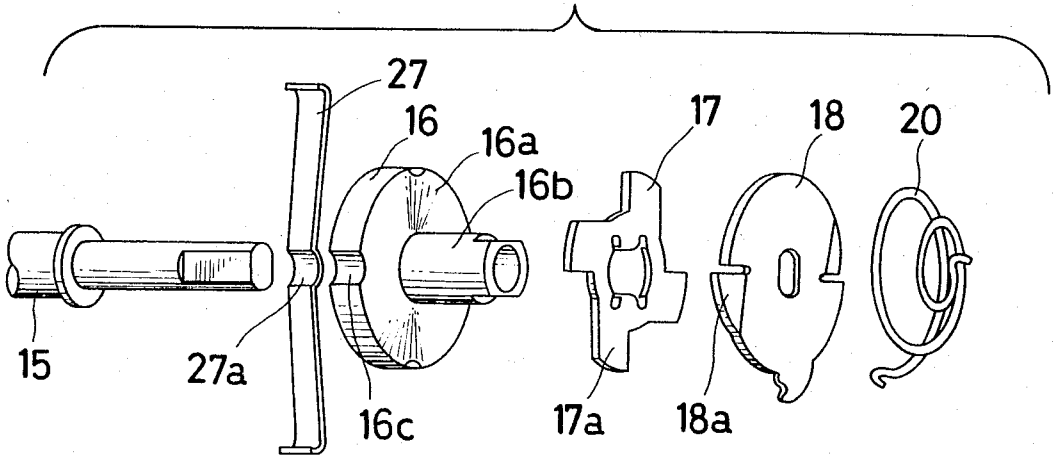
FIG. 2 (PRIOR ART)
FIG. 2 is a fragmentary exploded perspective view of the lumbar support adjusting apparatus shown in FIG. 1.

FIGS. 1 and 2 show a conventional lumbar support adjusting apparatus. The lumbar support adjusting apparatus has a torsion bar 12 having a distal end secured to a lumbar plate 11 held against the seat back of a seat, particularly a vehicle seat, for imposing forward pressing forces on the lumbar plate 11. The torsion bar 12 has a proximal end, which is pivotably movable and supported on a bracket 13. A shaft 15 is rotatably mounted on the bracket 13 and has an outer end secured to a handle 14. The shaft 15 is rotatable about its own axis by turning the handle 14. A cam 16 is rotatably mounted on the shaft 15 and has a cam face 16*a* engaging a projecting lobe 12*a* serving as a cam follower at the proximal end of the torsion bar 12. The cam 16 includes a shank 16*b* fitted axially over the shaft 15 and securely supporting a ratchet 17 having a plurality (four in the illustrated embodiment) of radial engagement members or teeth 17*a* angularly spaced in the circumferential direction. The ratchet 17 is mounted on the shaft 16*b* for rotation therewith. A release plate 18 is axially movable, but nonrotatably mounted on the shaft 15 and has a pair of pawls 18*a* engageable successively with the engagement members 17*a* for angularly moving the cam 16 about its own axis. The cam 16 rotatable with the ratchet 17 has on its circumferential surface a plurality (four in the illustrated embodiment) of recesses 16*c* circumferentially spaced at equal angular intervals and engageable one at a time with a locking projection 27*a* on a leaf spring 27 fixed at ends to side plates 13*a*, 13*a* of the bracket 13.

The release plate 18 is normally urged to be pressed against the ratchet 17 and return in its direction of rotation under the resiliency of a conical spring 20 having one end hooked on an outer circumferential edge of the release plate 18 and the other end hooked on a support plate 19 fixed to the bracket 13. When the conical spring 20 is twisted by rotation of the shaft 15, there is a tendency for an outer circumferential edge of the release plate 18 to be lifted off the ratchet 17. When this happens, the pawls 18 of the release plate 18 are disengaged from the engagement members 17*a* of the ratchet 17, and the release plate 18 rotates idly, failing to cause the cam 16 to rotate. As a consequence, the torsion bar 12 cannot be adjusted in its pressing force against the seat back. This difficulty arises out of the fact that the conical spring 20 is cantilevered at its one end on the release plate 18 while serving as both a compression spring and a torsion spring. It is difficult to assemble and adjust the conical spring 20 properly.

The present invention will now be described with reference to FIGS. 3 and 4. Like or corresponding parts shown in FIGS. 3 and 4 are denoted by like or corresponding reference characters in FIGS. 1 and 2, and will not be described in detail.

Figure 3:
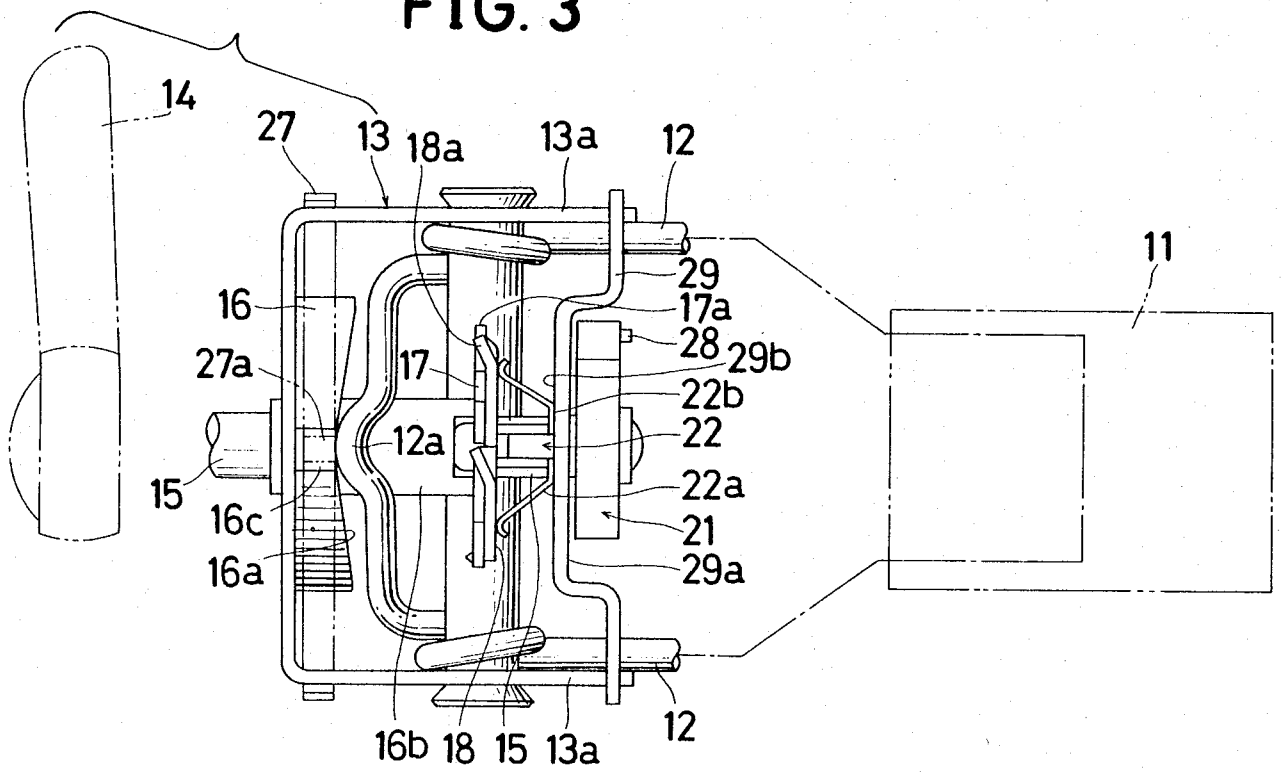
FIG. 3 is a front elevational view of a lumbar support adjusting apparatus according to the present invention.
Figure 4:
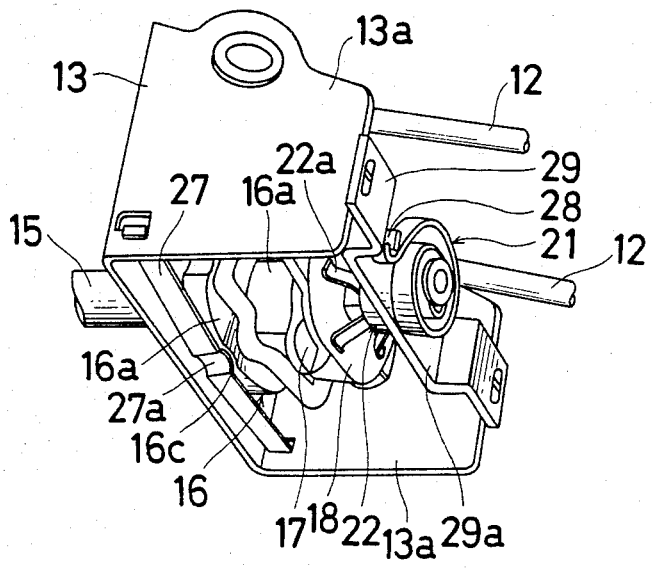
FIG. 4 is a perspective view of the lumbar support adjusting apparatus illustrated in FIG. 3.
Figures 5A, 5B, 5C, 5D:
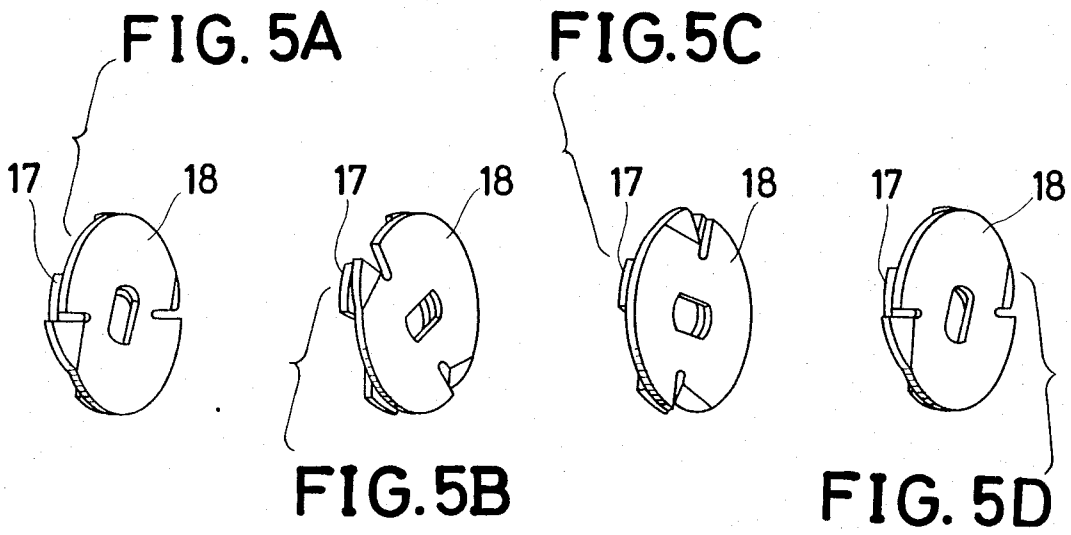
FIGS. 5A through D are perspective views of a release plate in the apparatus of FIG. 3, showing successive operative positions of the release plate.

As shown in FIGS. 3 and 4, a support plate 29 is attached at its ends to the side plates 13*a*, 13*a* of the bracket 13 and has a central recessed portion 29*a* through which a distal end of the shaft 15 projects. A spiral spring 21 is mounted on the central recessed portion 29*a*. A compression spider spring 22 is in the form of a leaf spring having a head (described later) supported on the central recessed portion 29*a* at a surface facing away from the spiral spring 21. The spiral spring 21 has one end fixed to a projection on the shaft 15 and the other end secured to a pin 28 projecting from the recessed portion 29*a* of the support plate 29. The spiral spring 21 normally urges the shaft 15 to return when the latter is rotated against the resiliency of the spiral spring 21.

The compression spider spring 22 comprises a flat head 22b fitted over the shaft 15 and four radial legs 22a spaced at equal angular intervals and extending radially outwardly from the head 22b. The legs 22a have bent ends held against the release plate 18. The compression spider spring 22 is disposed under compression between the surface 29b of the central recessed portion 29a and the release plate 18 for pressing the latter with substantially uniform forces around the release plate 18. The other structural features are the same as those shown in FIGS. 1 and 2.

With the arrangement of the present invention, the release plate 18 is pressed against the ratchet 17 under substantially uniform forces from the legs 22a of the compression spider spring 22. When the shaft 15 is rotated about its own axis by the handle 14, the pawls 18a of the release plate 18 are brought into reliable engagement with the engagement members 17a of the ratchet 17, causing the ratchet 17 to turn against the biasing force of the spiral spring 21. During such angular movement of the ratchet 17, one of the recesses 16c on the cam 16 is moved out of engagement with the locking projection 27a of the leaf spring 27, and an adjacent recess 16c is brought into engagement with the locking projection 27a. At the same time, the cam face 16a of the cam 16 is angularly moved to displace the projecting lobe 12a of the torsion bar 12 for thereby adjusting the pressing force of the torsion bar 12. Upon releasing the handle 14, the release plate 18 is angularly returned to its angular original position under the biasing force of the spiral spring 21. During the returning movement, the pawls 18a of the release plate 18 ride over and move past the following engagement members 17a of the ratchet 17 until the pawls 18a engage these engagement members 17a. FIGS. 5A through 5D illustrate the successive positions in which the ratchet 17 and the release plate 18 engage operatively with each other.

While in the illustrated embodiment the compression spring 22 comprises a leaf spring having a plurality of spider legs 22a, the compression spring may be in the form of a coil spring.

Although a certain preferred embodiment has been shown and described, it should be understood that many changes and modifications may be made therein without departing from the scope of the appended claims.

What is claimed is:

1. An apparatus for adjusting a lumbar support having a lumbar plate held against a seat back, comprising:

(a) a bracket;

(b) a torsion bar having an end connected to said lumbar plate for applying force to said lumbar plate, said lumbar plate also having an opposite end being angularly movable and supported on said bracket, said opposite end having a cam follower projection;

(c) a handle-operated shaft rotably mounted on said bracket;

(d) means for rotating said shaft;

(e) a cam rotably mounted on said shaft and having a shank, a cam face engaging said cam follower projection and a plurality of recessed members on the outer peripheral surface thereof, (f) a leaf spring having a locking projection for individual engagement with said recessed members on said cam;

(g) a ratchet mounted on said shank and having a plurality of radial teeth;

(h) a release plate mounted on said shaft, said release being axially movable therewith and having a plurality of pawls engageable with said radial teeth for turning said cam in response to rotation of said shaft thereby adjusting the force on said lumbar plate applied by said torsion bar;

(i) a support plate mounted on said bracket, said shaft having one end projecting through said support plate;

(j) a torsion spring having one end secured to said one end of said shaft and the other end connected to said support plate; and (k) compression means for urging said release plate against said ratchet.

2. An apparatus according to claim 1, wherein said torsion spring and said compression spring are disposed one on each side of said support plate.

3. An apparatus according to claim 1, wherein said torsion spring comprises a spiral spring.

4. An apparatus according to claim 1, wherein said compression spring comprises a leaf spring having a plurality of legs extending radially outwardly and held against said release plate.

5. An apparatus according to claim 1, wherein said support plate has a recessed portion with said torsion spring mounted thereon.

6. An apparatus according to claim 5, wherein said compression spring has a central head supported on said recessed portion remotely from said torsion spring.

* * * * *